US007274328B2

(12) United States Patent
McIntire et al.

(10) Patent No.: US 7,274,328 B2
(45) Date of Patent: Sep. 25, 2007

(54) TRANSMITTING AND RECEIVING RADIO FREQUENCY SIGNALS USING AN ACTIVE ELECTRONICALLY SCANNED ARRAY

(75) Inventors: Gregory D. McIntire, Princeton, TX (US); Cyrus E. Clark, Plano, TX (US)

(73) Assignee: Raytheon Company, Waltham, MA (US)

( * ) Notice: Subject to any disclaimer, the term of this patent is extended or adjusted under 35 U.S.C. 154(b) by 366 days.

(21) Appl. No.: 10/931,139

(22) Filed: Aug. 31, 2004

(65) Prior Publication Data

US 2006/0055599 A1 Mar. 16, 2006

(51) Int. Cl.
*H01Q 3/26* (2006.01)

(52) U.S. Cl. ..... 342/368

(58) Field of Classification Search ..... 342/368, 342/373

See application file for complete search history.

(56) References Cited

U.S. PATENT DOCUMENTS

| | | | | |
|---|---|---|---|---|
| 5,959,578 | A * | 9/1999 | Kreutel, Jr. | 342/368 |
| 6,016,123 | A | 1/2000 | Barton et al. | 342/373 |
| 6,430,421 | B1 * | 8/2002 | Kiiski et al. | 455/562.1 |
| 6,728,554 | B1 * | 4/2004 | Wegner | 455/562.1 |
| 2001/0001808 | A1 * | 5/2001 | Chassaing et al. | |

FOREIGN PATENT DOCUMENTS

| | | |
|---|---|---|
| EP | 0 805 360 A2 | 11/1997 |
| EP | 1 381 083 A2 | 1/2004 |

OTHER PUBLICATIONS

Adjacent, Merriam-Webster OnLine Dictionary, http://www.m-w.com/dictionary/adjacent.*

PCT, Notification of Transmittal of The International Search Report and The Written Opinion of The International Searching Authority, or The Declaration, International Application No. PCT/US2005/030305; dated Feb. 10, 2006.

Gipprich, J.W., et al., "A Compact LTCC Multilayer Multiport Stripline Coupler Network for Wideband Low Loss Power Combining/Splitting", 0-7803-2411-0/94, © 1994 IEEE, pp. 167-169.

(Continued)

*Primary Examiner*—Thomas H. Tarcza
*Assistant Examiner*—Fred H. Mull
(74) *Attorney, Agent, or Firm*—Baker Botts L.L.P.

(57) ABSTRACT

A system for transmitting and receiving signals includes an array system of one or more active electronically scanned arrays. The array system includes a receive portion of a first number of receive elements and a transmit-receive portion of a second number of transmit-receive elements. A transmit-receive element includes monolithic microwave integrated circuit power amplifiers and low-loss miniature combiners. A signal processing system processes signals. A beam forming system generates receive beams of the receive elements. A receive beam has a receive beam beamwidth that is less than a transmit beam beamwidth of a transmit beam of the transmit-receive elements.

14 Claims, 2 Drawing Sheets

OTHER PUBLICATIONS

Gipprich, John, et al., A Compact 8-14 GHZ LTCC Stripline Coupler Network for High Efficiency Power Combining with Better than 82% Combining Efficiency, TH4C-3, © 1995 IEEE, pp. 1583-1586.

U.S. Appl. No. 10/192,891, filed Jul. 11, 2002, entitled, "Method and Apparatus for Cooling with Coolant at a Subambient Pressure", by inventor Richard M. Weber, 21 pages of text and 2 pages of drawings.

U.S. Appl. No. 10/193,571, filed Jul. 11, 2002, entitled, "Method and Apparatus for Removing Heat from a Circuit", by inventors James L. Haws, et al, 33 pages of text and 3 pages of drawings.

U.S. Appl. No. 10/698,953, filed Oct. 31, 2003, entitled "Method and Apparatus for Cooling Heat-Generating Structure", by inventors Richard M. Weber, et al, 42 pages of text and 6 pages of drawings.

* cited by examiner

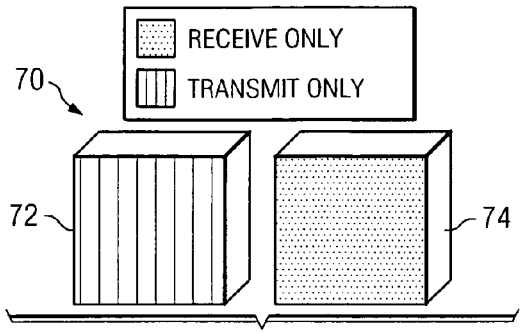
FIG. 3A
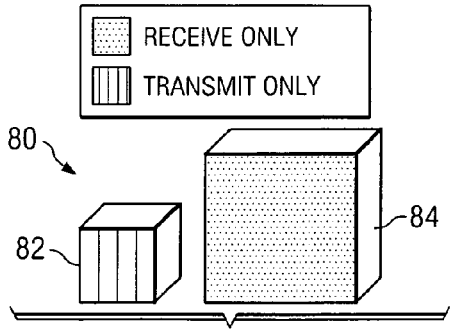
FIG. 3B
FIG. 4
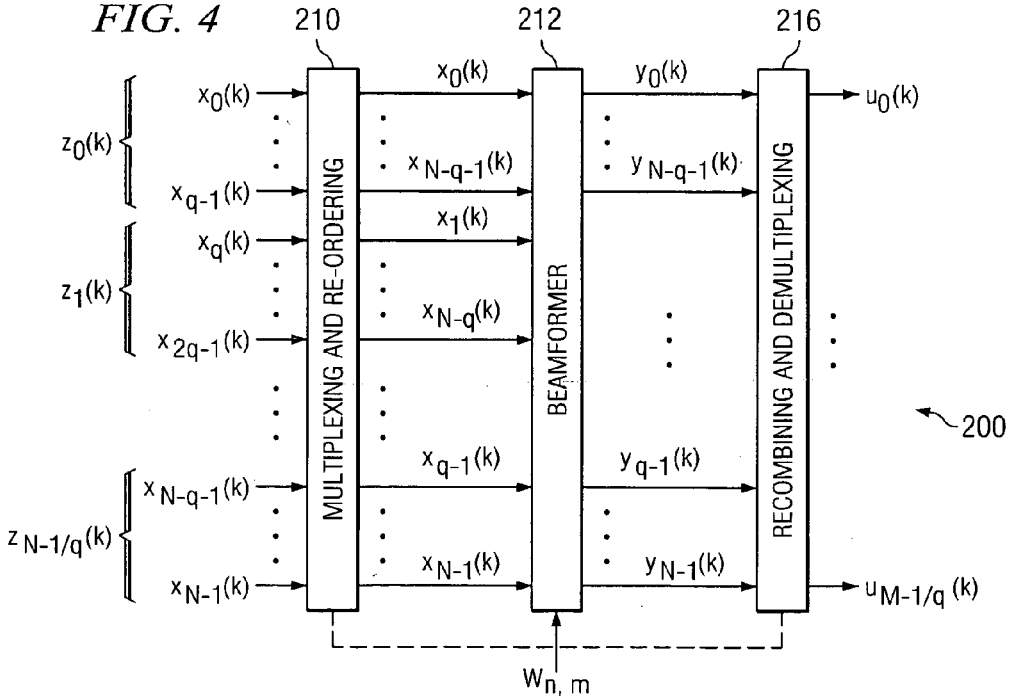

TRANSMITTING AND RECEIVING RADIO FREQUENCY SIGNALS USING AN ACTIVE ELECTRONICALLY SCANNED ARRAY

TECHNICAL FIELD

This invention relates generally to the field of radar systems and more specifically to a method and system for transmitting and receiving signals using an active electronically scanned array.

BACKGROUND

Radar systems may use an active electronically scanned array (AESA) to steer a radar beam. An AESA includes an antenna populated with transmit and receive elements. The weight and cost of an AESA are typically proportional to the number of transmit elements. A known technique for reducing the cost and weight is to randomly eliminate transmit elements. Decreasing the number of transmit elements, however, reduces array gain and radio frequency (RF) power. Moreover, randomly eliminating transmit elements degrades side lobe performance. Accordingly, it is difficult to have low cost, light weight effective signal communication using an AESA.

SUMMARY OF THE DISCLOSURE

In accordance with the present invention, disadvantages and problems associated with previous techniques for transmitting and receiving signals using an active electronically scanned array may be reduced or eliminated.

According to one embodiment, a system for transmitting and receiving signals includes an array system of one or more active electronically scanned arrays. The array system includes a receive portion of a first number of receive elements and a transmit-receive portion of a second number of transmit-receive elements. A transmit-receive element includes monolithic microwave integrated circuit power amplifiers and low-loss miniature combiners. A signal processing system processes signals. A beam forming system generates receive beams of the receive elements. A receive beam has a receive beam beamwidth that is less than a transmit beam beamwidth of a transmit beam of the transmit-receive elements.

Certain embodiments of the invention may provide one or more technical advantages. A technical advantage of one embodiment may be that an AESA system may include a reduced number of transmit elements. A transmit element may have a relatively high transmit power to compensate for the reduced number of transmit elements. Another technical advantage of one embodiment may be that a beam forming system may be used to generate multiple receive beams. Multiple receive beams may be used to provide a total receive beamwidth comparable to the wider transmit beam resulting from the reduced number of transmit elements.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which:

FIGS. 3A and 3B illustrate example array systems that may be used with the system of FIG. 1; and FIG. 4 is a block diagram illustrating one embodiment of a beam forming system that may be used with the system of FIG. 1.

DETAILED DESCRIPTION OF THE DRAWINGS

Embodiments of the present invention and its advantages are best understood by referring to FIGS. 1 through 4 of the drawings, like numerals being used for like and corresponding parts of the various drawings.

Figure 1:
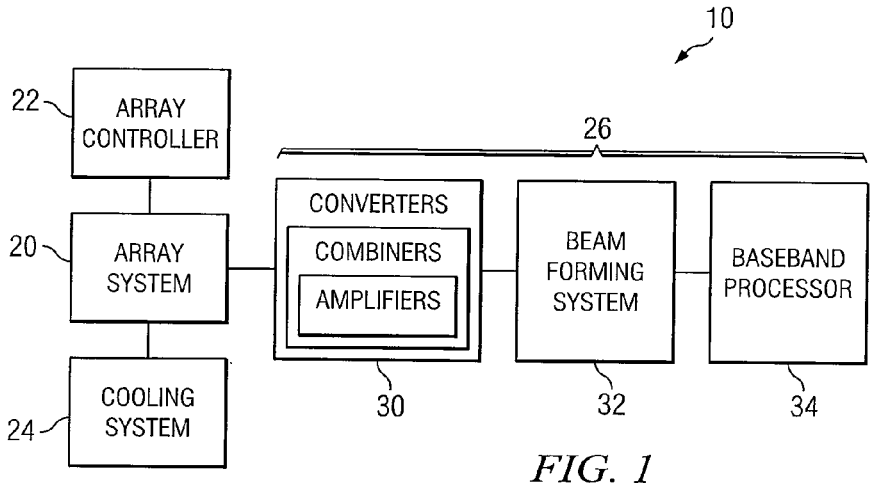
FIG. 1 is a block diagram of one embodiment of a system for transmitting and receiving signals using an active electronically scanned array.

FIG. 1 is a block diagram of one embodiment of a system 10 for transmitting and receiving signals using an active electronically scanned array. In general, system 10 includes an array system, a cooling system, and a beam forming system. The array system includes receive elements and a reduced number of high power transmit elements. The cooling system may be used to cool the high power transmit elements. The beam forming system may be used to generate multiple receive beams that provide a total receive beamwidth comparable to the wider transmit beam resulting from the reduced number of transmit elements.

According to the illustrated example, system 10 includes an array system 20, an array controller 22, a cooling system 24, and one or more signal processing components 26 coupled as shown. Signal processing components 26 includes frequency converters 30, a beam forming system 32, and a baseband processor 34 coupled as shown.

Array system 20 comprises any suitable number of active electronically scanned arrays. For example, array system 20 includes twenty arrays. An array includes elements such as receive elements, transmit elements, transmit-receive elements, or any combination of the preceding. A receive element receives signals, and comprises a receive-only element that only receives signals. A transmit element transmits signals, and comprises a transmit-only element that only transmits signals. A transmit-receive element transmits signals or receives signals. The elements of an array may grouped into subarrays.

Array system 20 includes receive elements and a reduced number of high power transmit elements. For example, array system 20 may have approximately the same number of transmit-receive elements and of receive elements, for example, 2,560 transmit-receive elements and 2,560 receive elements. As another example, more transmit-receive elements may be used than receive elements. For example, 2,560 transmit-receive elements and 1,536 receive elements may be used. The elements of an array may be arranged in any suitable configuration. Example configurations are described with reference to FIGS. 2A through 3C. The elements may be spaced at any suitable interval. According to one example, the interval between the elements may be approximately one-half of a wavelength, for example, one-half of one inch.

High power transmit elements may be used in array system 20 to compensate for reduced transmit power due to the reduced number of transmit elements. A high power transmit element may refer to a transmit element having a transmit power that is greater than a reference power level.

The reference power level may refer to a power level that is used to compare transmit elements, and may be greater than one-half of one watt. According to one embodiment, a high power transmit element may be implemented using monolithic microwave integrated circuit (MMIC) power amplifiers. Any suitable number of power amplifiers may be used, for example, more than four, six, or eight amplifiers.

According to one embodiment, the power amplifiers may be located in a power amplifier carrier that has an operating bandwidth of 8 to 12 gigahertz and a duty cycle of approximately 10% or other suitable power amplifier. A power amplifier carrier may hold, for example, six MMIC power amplifiers along with distributed switching. Low-loss miniature combiners may be used to combine the amplifiers in parallel to increase the transmit power.

According to one embodiment, elements may be located on transmit-receive integrated microwave modules (TRIMMs). An array may include any suitable number of TRIMMS, for example, sixteen TRIMMs. TRIMMs may be grouped into subarrays. A TRIMM may include any suitable number of elements, for example, sixteen elements. A TRIMM may also include other components, for example, one or more radiators, circulators, power amplifiers, regulators, power converters, radio frequency manifolds, controllers, or any combination of the preceding. A housing for the arrays may have shelves that each support one or more arrays. Array system 20 may be scaled by adding TRIMMs to or removing TRIMMs from the shelves.

Array controllers 22 may be provided at the array level, subarray level, element level, or any combination of the preceding. Control at the subarray level allows for a scalable array. Control at the element level allows for amplitude, phase, and power control for operation and calibration.

Cooling system 24 operates to remove heat from system 10. Cooling system 24 may provide a coolant to array system 20 that removes heat that may be generated by the high power amplifiers of the transmit elements of array system 20.

Converters 30 may include a radio frequency (RF)-to baseband (BB)-converter and a BB-to-RF converter. An RF-to-BB converter converts a signal from a RF to BB, and a BB-to-RF converter converts a signal from a BB to RF. Converters 30 may also include an analog-to-digital converter (A/D) and a digital-to-analog converter (D/A). An A/D converts a signal from an analog form to a digital form, and a D/A converts a signal from a digital form to an analog form. Baseband processor 34 processes signals at the baseband level.

Beam forming system 32 steers beams by applying weights to the signals of the elements. A different combination of weights may steer the beam to a different direction. The reduced number of transmit elements typically yields a wider transmit beam. Accordingly, beam forming system 32 may be used to generate multiple receive beams to cover the wider transmit beam. For example, the reduced number of transmit elements may yield a transmit beam of three degrees. Beam forming system 32 may generate two simultaneous receive beams, each having a width of 1.5 degrees, to provide a total receive beamwidth comparable to the three degree transmit beam. Beam forming system 32 may use any suitable analog or digital technique for generating multiple beams. An example of a technique that may be used is described with reference to FIG. 4.

TABLE 1 illustrates example parameters that may be used with system 10.

TABLE 1

| Parameter | Case 1 | Case 2 | Case 3 |
|---|---|---|---|
| Number of Transmit Elements | 4000 | 2000 | 1000 |
| Transmit Power Per Element (watts relative) | 1X | 4X | 16X |
| Total Transmit Power (watts relative) | 4000X | 8000X | 16000X |
| Transmit Aperture Gain (relative) | G | 0.5G | 0.25G |
| Transmit Beamwidth (degrees) | Z | 2Z | 4Z |
| Effective Radiated Power (watts relative) | 4000XG | 4000XG | 4000XG |
| Number of Receive Elements | 4000 | 4000 | 4000 |
| Receive Beamwidth (degrees) | Z | Z | Z |
| Number of Receive Beams | 1 | 2 | 4 |
| Signal-to-Noise Ratio | Y | Y | Y |
| Radar Frame Time (sec) | 4 | 4 | 4 |

TABLE 1 provides Cases 1, 2, and 3 with example values for parameters of system 10. The values are only examples provided for illustration purposes. The parameters include the number of transmit elements of array system 20, the transmit power per element relative to the other cases, the transmit aperture gain relative to the other cases, and the transmit beamwidth relative to the other cases. The transmit power per element is expressed using reference power level X. The transmit aperture gain is expressed using reference aperture gain level G. The transmit beamwidth is expressed using reference transmit beamwidth Z. The parameters also include the number of receive elements of array system 20, the receive beamwidth of each beam relative to the other cases, the number of receive beams, the signal-to-noise ratio relative to the other cases, and the radar frame time in seconds. The receive beamwidth is expressed using reference level Z. The signal-to-noise ratio is expressed using reference level Y.

According to TABLE 1, when the number of transmit elements is halved, there is a loss in transmit array area, array gain, and transmit power. Increasing the module transmit power by a factor of four each time recovers the losses. For these examples, only one dimension of the transmit array was reduced. The transmit array may be reduced in two dimensions.

Modifications, additions, or omissions may be made to system 10 without departing from the scope of the invention. The components of system 10 may be integrated or separated according to particular needs. Moreover, the operations of system 10 may be performed by more, fewer, or other modules. For example, the operations of beam forming system 32 and baseband processor 34 may be performed by one module. Additionally, operations of system 10 may be performed using any suitable logic comprising software, hardware, other logic, or any suitable combination of the preceding.

Figure 2A:
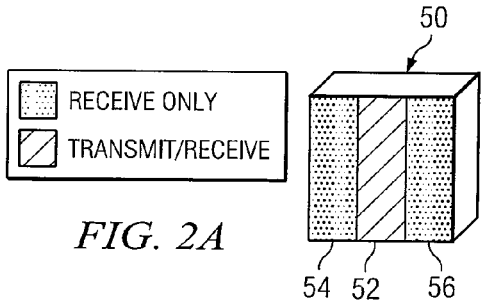
FIGS. 2A and 2B illustrate example array systems that may be used with the system of FIG. 1.
Figure 2B:
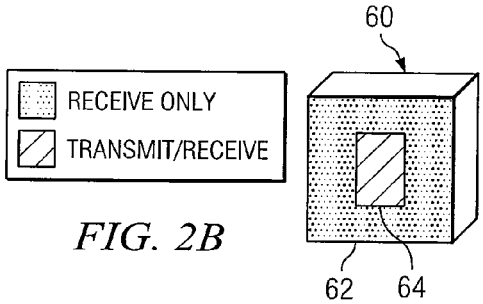

FIGS. 2A and 2B illustrate example arrays systems that may be used with system 10 of FIG. 1. FIG. 2A illustrates an array system 50 that includes a transmit-receive subarray 52 and receive subarrays 54 and 56. A portion of an array system 20 may refer to a part of array system 20 that includes a certain type of element. The part may comprise one or more subarrays, one or more arrays, or any combination of the preceding. In the illustrated example, a portion comprises a subarray. Transmit-receive subarray 52 includes transmit-receive elements, and may include only transmit-receive elements. Receive subarrays 54 and 56 include receive elements, and may include only receive elements.

In this particular embodiment, transmit-receive subarray 52 is "adjacent" to receive subarrays 54 and 56, which means that transmit-receive subarray 52 is "in contact with" receive subarrays 54 and 56.

FIG. 2B illustrates an example array system 60 that includes a transmit-receive subarray 62 and a receive subarray 64. Transmit-receive subarray 62 includes transmit-receive elements, and may include only transmit-receive elements. Receive subarray 64 includes receive elements, and may include only receive elements.

In this particular embodiment, transmit-receive subarray 62 is adjacent to receive subarray 64.

FIGS. 3A and 3B illustrate example array systems that may be used with system 10 of FIG. 1. FIG. 3A illustrates an example array system 70 that includes arrays 72 and 74. Array 72 operates as a transmit portion. Array 72 includes transmit elements, and may include only transmit elements. Array 74 operates as a receive portion. Array 74 includes receive elements, and may include only receive elements. Arrays 72 and 74 are substantially the same size and include substantially the same number of elements.

FIG. 3B illustrates an array system 80 that includes arrays 82 and 84. Array 82 operating as a transmit portion includes transmit elements, and may include only transmit elements. Array 84 operating as a receive portion includes receive elements, and may include only receive elements. Array 82 is smaller than array 84 and includes fewer elements than that of 84. For example, array 82 may include less than one-third, such as less than one-fourth of the number of elements of array 84.

Modifications, additions, or omissions may be made to array systems 50, 60, 70, and 80 without departing from the scope of the invention. The arrays may have more or fewer elements configured in any suitable manner.

FIG. 4 is a block diagram illustrating one embodiment of a beam forming system 200 that may be used with system 10 of FIG. 1. According to the illustrated embodiment, beam forming system 200 includes a multiplexing and reordering module 210, a beam former 212, and a recombining and demultiplexing module 216 coupled as shown.

Multiplexing and reordering module 210 receives signals $x_n(k)$ carrying complex input data from an antenna element n at time $t_k$, where k is the sample index. Signals $x_n$ (k) are received by receive elements $z_j$ (k). Multiplexing and reordering module 210 multiplexes and reorders signals $x_n$ (k). Beamformer 212 applies weights $w_{n,m}$ (k) to signals $x_n$ (k) to yield partial product signals $y_m$ (k) with complex output data for beam m at time $t_k$. Data recombining and multiplexing module 216 recombines and demultiplexes signals $y_m$ (k) to yield the formed beam $u_m$ (k). Any suitable number of beams may be formed. For example, ten beams may be formed for a high data rate, and two thousand beams may be formed for a low data rate. Multiplexing and re-ordering may not be required for analog embodiments of beamformer 212.

Modifications, additions, or omissions may be made to beam forming system 100 without departing from the scope of the invention. The components of beam forming system 100 may be integrated or separated according to particular needs. Moreover, the operations of beam forming system 100 may be performed by more, fewer, or other modules. For example, the operations of multiplexing and re-ordering module 210 may be performed by more than one module. Additionally, operations of beam forming system 100 may be performed using any suitable logic comprising software, hardware, other logic, or any suitable combination of the preceding.

Certain embodiments of the invention may provide one or more technical advantages. A technical advantage of one embodiment may be that an AESA system may include a reduced number transmit elements. Each transmit element may have a high transmit power to compensate for the reduced number of transmit elements. Another technical advantage of one embodiment may be that a beam forming system may be used to generate multiple receive beams. Multiple receive beams may be used to cover the wider transmit beam resulting from the reduced number of transmit elements.

While this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the following claims.

What is claimed is:

1. A system for transmitting and receiving a plurality of radio frequency signals, comprising:

an array system comprising one or more active electronically scanned arrays, the array system comprising:

a receive portion comprising a first number of receive elements, a receive element operable to receive a receive signal; and a transmit-receive portion disposed adjacent the receive portion, the transmit-receive portion comprising a second number of transmit-receive elements, the transmit-receive elements having a transmit element power and operable to transmit a transmit signal or to receive a receive signal, the transmit-receive elements comprising:

a plurality of monolithic microwave integrated circuit power amplifiers; and a low-loss miniature combiner operable to couple an output signal of the power amplifiers into the transmit signal;

a signal processing system operable to:

receive the receive signal from the receive elements;

process the receive signal;

process the transmit signal; and provide the transmit signal to the transmit-receive elements; and a beam forming system operable to generate a plurality of receive beams associated with the receive elements, a receive beam having a receive beam beamwidth that is less than a transmit beam beamwidth of a transmit beam associated with the transmit-receive elements.

2. The system of claim 1, wherein the plurality of receive beams is operable to provide a composite beamwidth comparable to the transmit beam beamwidth associated with the transmit-receive elements.

3. The system of claim 1, further comprising a cooling system operable to:

provide a coolant to the array system, the coolant operable to receive heat from the array system;

receive the heated coolant from the array system;

cool the coolant; and provide the cooled coolant to the array system.

4. A method for transmitting and receiving a plurality of radio frequency signals, comprising:

receiving a plurality of receive signals at a receive portion of an array system comprising one or more active electronically scanned arrays, the receive portion comprising a first number of receive elements, a receive element operable to receive a receive signal of the plurality of receive signals; and transmitting a transmit signal from a transmit-receive portion of the array system, the transmit-receive portion disposed adjacent the receive portion, the transmit-receive portion comprising a second number of transmit-receive elements, the transmit-receive elements having a transmit element power and operable to transmit a transmit signal or to receive a receive signal, the transmit-receive elements comprising:

a plurality of monolithic microwave integrated circuit power amplifiers; and a low-loss miniature combiner operable to couple an output signal of the power amplifiers into the transmit signal; and generating a plurality of receive beams associated with the receive elements, a receive beam having a receive beam beamwidth that is less than a transmit beam beamwidth of a transmit beam associated with the transmit-receive elements.

5. The method of claim 4, wherein the plurality of receive beams is operable to provide a composite beamwidth comparable to the transmit beam beamwidth associated with the transmit-receive elements.

6. The method of claim 4, further comprising a cooling system operable to:

provide a coolant to the array system, the coolant operable to receive heat from the array system;

receiving the heated coolant from the array system;

cooling the coolant; and providing the cooled coolant to the array system.

7. A system for transmitting and receiving a plurality of radio frequency signals, comprising:

an array system comprising one or more active electronically scanned arrays, the array system comprising:

a receive portion comprising a first number of receive elements, a receive element operable to receive a receive signal; and a transmit portion disposed adjacent the receive portion, the transmit-receive portion comprising a second number of transmit elements, the transmit elements having a transmit element power and operable to transmit a transmit signal, the transmit elements comprising:

a plurality of monolithic microwave integrated circuit power amplifiers; and a low-loss miniature combiner operable to couple an output signal of the power amplifiers into the transmit signal;

a signal processing system operable to:

receive the receive signal from the receive elements;

process the receive signal;

process the transmit signal; and provide the transmit signal to the transmit elements; and a beam forming system operable to generate a plurality of receive beams associated with the receive elements, a receive beam having a receive beam beamwidth that is less than a transmit beam beamwidth of a transmit beam associated with the transmit elements.

8. The system of claim 7, wherein the plurality of receive beams is operable to provide a composite beamwidth comparable to the transmit beam beamwidth associated with the transmit elements.

9. The system of claim 7, further comprising a cooling system operable to:

provide a coolant to the array system, the coolant operable to receive heat from the array system;

receive the heated coolant from the array system;

cool the coolant; and provide the cooled coolant to the array system.

10. A method for transmitting and receiving a plurality of radio frequency signals, comprising:

receiving a plurality of receive signals at a receive portion of an array system comprising one or more active electronically scanned arrays, the receive portion comprising a first number of receive elements, a receive element operable to receive a receive signal of the plurality of receive signals; and transmitting a transmit signal from a transmit portion of the array system, the transmit portion disposed adjacent the receive portion, the transmit-receive portion comprising a second number of transmit elements, the transmit elements having a transmit element power and operable to transmit a transmit signal, the transmit elements comprising:

a plurality of monolithic microwave integrated circuit power amplifiers; and a low-loss miniature combiner operable to couple an output signal of the power amplifiers into the transmit signal; and generating a plurality of receive beams associated with the receive elements, a receive beam having a receive beam beamwidth that is less than a transmit beam beamwidth of a transmit beam associated with the transmit elements.

11. The method of claim 10, wherein the plurality of receive beams is operable to provide a composite beamwidth comparable to the transmit beam beamwidth associated with the transmit elements.

12. The method of claim 10, further comprising:

providing a coolant to the array system, the coolant operable to receive heat from the array system;

receiving the heated coolant from the array system;

cooling the coolant; and providing the cooled coolant to the array system.

13. A system for transmitting and receiving a plurality of radio frequency signals, comprising:

means for receiving a plurality of receive signals at a receive portion of an array system comprising one or more active electronically scanned arrays, the receive portion comprising a first number of receive elements, a receive element operable to receive a receive signal of the plurality of receive signals; and means for transmitting a transmit signal from a transmit-receive portion of the array system, the transmit-receive portion disposed adjacent the receive portion, the transmit-receive portion comprising a second number of transmit-receive elements, the transmit-receive elements having a transmit element power and operable to transmit a transmit signal or to receive a receive signal, the transmit-receive elements comprising:

a plurality of monolithic microwave integrated circuit power amplifiers; and a low-loss miniature combiner operable to couple an output signal of the power amplifiers into the transmit signal; and means for generating a plurality of receive beams associated with the receive elements, a receive beam having a receive beam beamwidth that is less than a transmit beam beamwidth of a transmit beam associated with the transmit-receive elements.

14. A system for transmitting and receiving a plurality of radio frequency signals, comprising:

an array system comprising one or more active electronically scanned arrays, the array system comprising:

a receive portion comprising a first number of receive elements, a receive element operable to receive a receive signal; and a transmit-receive portion comprising a second number of transmit-receive elements disposed adjacent the receive portion, the transmit-receive elements having a transmit element power and operable to transmit a transmit signal, the transmit-receive elements comprising:

a plurality of monolithic microwave integrated circuit power amplifiers; and a low-loss miniature combiner operable to couple an output signal of the power amplifiers into the transmit signal;

a signal processing system operable to:

receive the receive signal from the receive elements;

process the receive signal;

process the transmit signal; and provide the transmit signal to the transmit-receive elements;

a beam forming system operable to generate a plurality of receive beams associated with the receive elements, a receive beam having a receive beam beamwidth that is less than a transmit beam beamwidth of a transmit beam associated with the transmit-receive elements, the plurality of receive beams being operable to provide a composite beamwidth comparable to the transmit beam beamwidth associated with the transmit-receive elements; and a cooling system operable to:

provide a coolant to the array system, the coolant operable to receive heat from the array system;

receive the heated coolant from the array system;

cool the coolant; and provide the cooled coolant to the array system.

* * * * *